United States Patent [19]

Eberbach

[11] Patent Number: 4,885,782

[45] Date of Patent: Dec. 5, 1989

[54] SINGLE AND DOUBLE SYMMETRIC LOUDSPEAKER DRIVER CONFIGURATIONS

[75] Inventor: Steven J. Eberbach, Ann Arbor, Mich.

[73] Assignee: Howard Krausse, Ann Arbor, Mich.

[21] Appl. No.: 55,786

[22] Filed: May 29, 1987

[51] Int. Cl.[4] ..... H04R 1/26

[52] U.S. Cl. ..... 381/186; 381/24; 381/89; 381/90; 381/182; 181/144

[58] Field of Search ..... 181/144, 145, 146, 147, 181/148, 153; 381/24, 89, 90, 97, 98, 99, 150, 182, 184, 186, 188, 205, 156

[56] References Cited

U.S. PATENT DOCUMENTS

| | | | |
|---|---|---|---|
| 3,645,355 | 2/1972 | Long | 381/205 |
| 3,824,343 | 7/1974 | Dahlquist | 381/90 |
| 4,283,606 | 8/1981 | Buck | 179/115.5 |
| 4,349,697 | 9/1982 | Skabla | 381/99 |
| 4,421,949 | 12/1983 | Eberbach | 381/98 |
| 4,450,322 | 5/1984 | Wilson | 179/146 |
| 4,727,586 | 2/1988 | Johnson | 381/97 |

*Primary Examiner*—Donald J. Yusko
*Assistant Examiner*—Tyrone Queen
*Attorney, Agent, or Firm*—James M. Deimen

[57] ABSTRACT

New loudspeaker driver configurations comprise positioning the high frequency driver between symmetrically located lower frequency drivers and providing in combination electrical or acoustical delay to the high frequency driver relative to the lower frequency drivers. The lower frequency drivers are located above and below at equal distances from the high frequency driver or, with more than two lower frequency drivers, symmetrically about the high frequency driver. The sound pressure level and phase response is substantially equivalent to co-axial drivers including suitable high frequency electric delay circuitry operating at similar power levels. The delay for the high frequency driver is electrical or electrical in combination with a geometrical delay. With a stereo pair of loudspeakers the high frequency driver may be offset from the vertical between the above and below low frequency drivers in an outboard direction of the stereo pair. With a stereo pair including mid-range drivers, the mid-range drivers are located generally between the low frequency drivers symmetrically above and below the high frequency driver. The high frequency driver and mid-range drivers are offset from a vertical line between the low frequency drivers in an outboard direction for each loudspeaker of the stereo pair of loudspeakers. The driver placement forms an arc in each loudspeaker. With the loudspeakers paired, the driver locations appear as a pair of large parentheses "()". A combination of electrical delay and geometric delay, the latter created by the placement of the drivers in each loudspeaker, results in wide-angle dispersion of sound with accurate phase response.

10 Claims, 3 Drawing Sheets

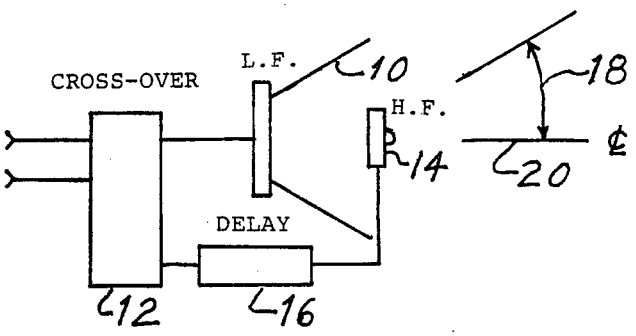
FIG. 1
FIG. 2
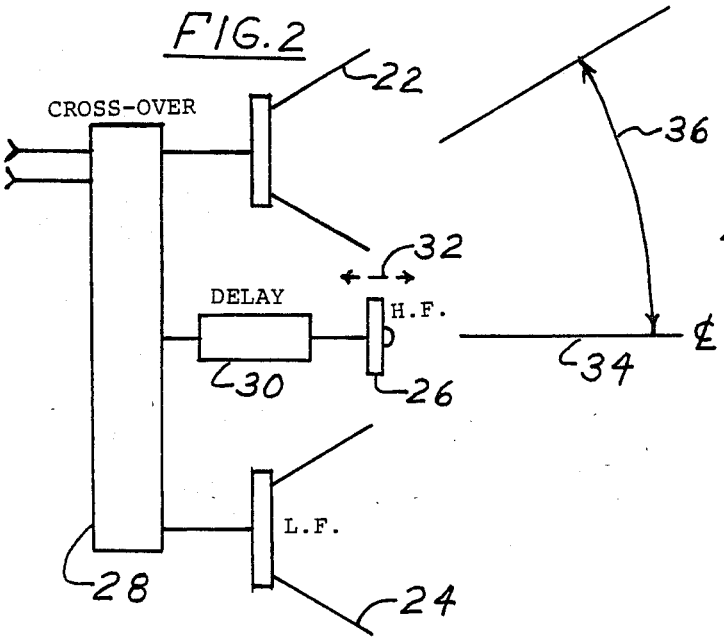
FIG. 3
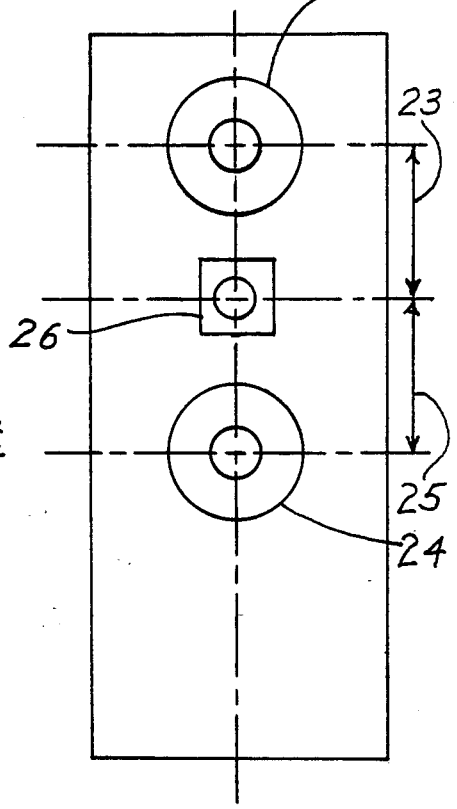
FIG. 4
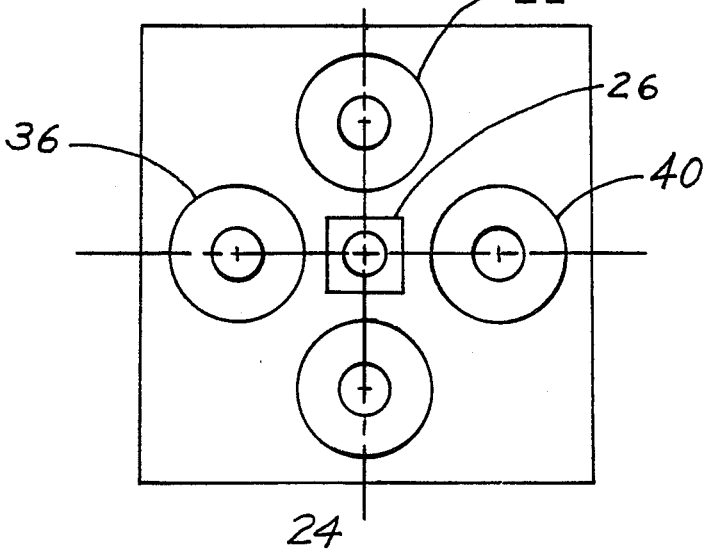

SINGLE AND DOUBLE SYMMETRIC LOUDSPEAKER DRIVER CONFIGURATIONS

BACKGROUND OF THE INVENTION

The invention pertains to the field of acoustic loudspeakers and, in particular, to audiophile quality stereophonic loudspeaker pairs.

Multitudinous loudspeakers have been developed over the years including a variety of loudspeakers and loudspeaker technology disclosed in applicant's U.S. Pat. Nos. 4,578,809, 4,430,527, 4,421,949 and 4,315,102. The loudspeaker technology disclosed below by applicant is an outgrowth of applicant's research and development activities partially based upon the technology disclosed in his above noted U.S. patents and several additional U.S. patent applications presently pending.

Coaxial loudspeakers comprising a high frequency driver normally located in front of a low frequency driver are well known in the art. Unfortunately, in such a configuration the high frequency sound would arrive at the listener's ears earlier than the low frequency sound. Therefore, proper coherence and phasing normally would dictate that the high frequency driver be located substantially congruent with or behind the low frequency driver. Such a configuration has been disclosed, as shown in U.S. Pat. No. 4,283,606. Applicant, however, has approached this problem previously by incorporating delay electrically in a circuit leading to the high frequency driver as disclosed in his U.S. Pat. No. 4,421,949.

Other approaches have been to separate the high frequency driver geometrically from the coaxial position to a position adjacent the low frequency driver and behind the low frequency driver as disclosed in U.S. Pat. No. 4,450,322. Such an approach, however, destroys the seeming point source geometry of the coaxial driver configuration.

SUMMARY OF THE INVENTION

The new loudspeaker driver configurations comprise positioning the high frequency driver symmetrically with respect to at least two lower frequency drivers and providing in combination electrical and acoustical (geometric) delay to the high frequency driver relative to the low frequency drivers. The lower frequency drivers are located above and below equidistant from the high frequency driver or, with more than two lower frequency drivers, symmetrically about the high frequency driver. In the embodiments disclosed, the delay equalization for the high frequency driver can be electrical or (preferably) a combination of electrical and geometric.

In a stereo pair of loudspeakers, it may be desirable, for improved illusion of imaging, to skew the radiation of middle frequencies (within the band where both high and low frequency drivers are operational) inward to the listening area between the loudspeakers. This is accomplished by using a configuration of two low or mid frequency drivers in a vertically oriented pair with the high frequency driver in between but offset slightly from the vertical axis joining the pair of low or mid frequency drivers. The skew is adjusted by changing the offset, and the remaining delay required for accurate amplitude and phase response at the preferred listening direction is provided by electrical delay equalization, as well as any delay inherent in the driver itself, such as the length of its horn, if it is a horn loaded driver. While it might be possible thus to stumble on an optimal combination of offset and delay without electrical delay equalization, in practice it has been found that the applicant's electrical delay adjustment allows almost any combination of off-the-shelf drivers to be adjusted electrically and geometrically for a superior radiation pattern from that obtainable without applicant's electrical delay equalization. Thus, the desired mix of slight skew of radiation pattern and wide angle accuracy is easy to achieve by varying the proportion of electrical and geometric delays in this vertical driver configuration using applicant's methods. In addition, this arrangement provides a reduction of diffractive cancellation from the cabinet edges since the time for sound to travel to the cabinet edges is slightly different for the low and high frequency drivers in the offset configuration, while it would be equal in the two-dimensionally symmetric configuration. Experience has proved this smooths the frequency response variations that would result from multiple energy diffractions arriving simultaneously at a listeners position near the axis of the speaker. Surprisingly, despite the substantial physical separation between each driver of a pair (mid-range or bass, for example) the combination in loudspeakers with applicant's electric delay means results in very accurate phase response in a very large volume about the loudspeaker. This is in contrast to linear phase response at a single listener location or along a single arc of listener locations. Applicant's result is equivalent to applicant's previous success in providing linear phase response in a volume about a coaxial loudspeaker incorporating applicant's electric delay means.

In a stereo pair of loudspeakers the high frequency driver is offset from the vertical between the above and below low frequency drivers in an outboard direction of the stereo pair. In a stereo pair of loudspeakers including mid-range drivers, the mid-range drivers are located generally between the low frequency drivers symmetrically above and below the high frequency driver. The high frequency driver and mid-range drivers are offset from a vertical line between the low frequency drivers in an outboard direction for each loudspeaker of the stereo pair. The driver placement forms an arc in each loudspeaker. With the loudspeakers paired, the driver locations appear as a pair of large parentheses "()". The combination of electric delay and geometric delay, the latter created by the placement of the drivers in each loudspeaker, results in wide-angle dispersion of sound with accurate phase response.

The symmetric loudspeaker driver configurations combined with applicant's electric delay equalization substantially duplicate the apparent point source dispersion of a coaxial driver configuration with applicant's electric delay equalization at similar power levels.

Applicant incorporates by reference the technology disclosed in his above noted issued U.S. patents and in addition incorporates by reference the technology disclosed in his pending United States patent application Ser. Nos. 456,365 and 562,724.

DESCRIPTION OF THE DRAWINGS

FIG. 1 is a schematic sketch of a coaxial driver and delay network;

FIG. 2 is a schematic sketch of a pair of symmetric low frequency drivers about a high frequency driver with delay network;

FIG. 3 is a schematic front view of the drivers of FIG. 2 in a loudspeaker;

FIG. 4 is a schematic front view of an alternative combination of the drivers in a loudspeaker, symmetric in two perpendicular directions;

DESCRIPTION OF THE PREFERRED EMBODIMENTS

Figure 5:
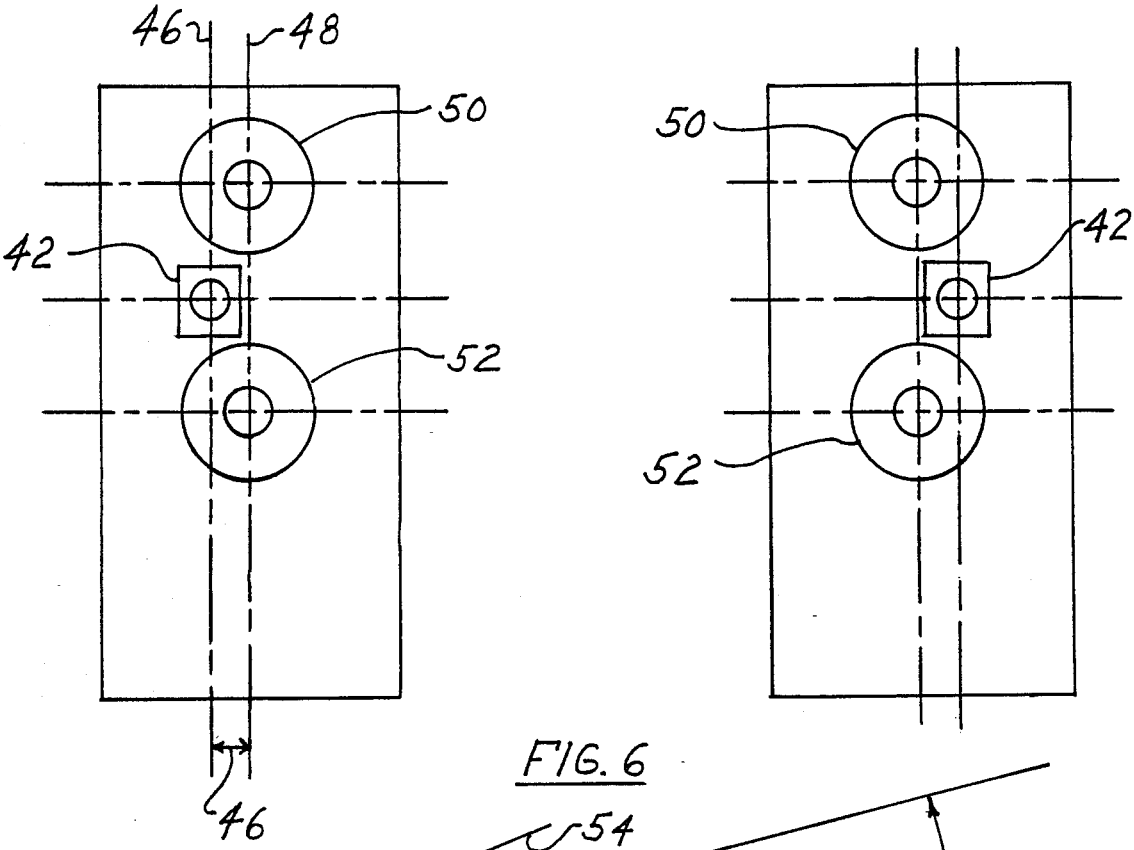
FIG. 5 is a schematic front view of an offset high frequency driver symmetric to a pair of low frequency drivers shown in a pair of mirror image loudspeakers.

Illustrated in FIG. 1 is a coaxial driver combination comprising a low frequency driver 10 electrically connected to a crossover circuit 12 and a high frequency driver 14 electrically connected to the crossover circuit 12 through a delay circuit 16. The delay circuit 16 may be incorporated in the crossover circuit 12. More detailed illustrations are disclosed in applicant's above referenced patents and applications. By moving the high frequency driver 14 axially and properly adjusting the delay circuit 17 a very wide solid angle with accurate phase response can be obtained as indicated schematically by the angle 18 from the driver axis 20.

Illustrated in FIGS. 2 and 3 is the simplest form of symmetric driver arrangement. Low frequency drivers 22 and 24 are located above and below respectively a high frequency driver 26. As indicated by arrows 23 and 25 the low frequency drivers 22 and 24 are spaced equidistant from the high frequency driver 26. The low frequency drivers 22 and 24 are electrically connected to a crossover circuit 28 and high frequency driver 26 is connected to the crossover circuit through a delay 30. The delay may be provided solely by electric means in the delay 30 or, alternatively, in combination with axial adjustment indicated by 32 of the high frequency driver 26 along its centerline 34. The proper adjustment of the electrical and geometric delay provides wide angle dispersion with accurate phase response as indicated by the angle 36.

To provide additional bass, two low frequency drivers 38 and 40 may be added to either side of the high frequency driver 26. In this embodiment all of the low frequency drivers 22, 24, 38 and 40 are equidistant from the high frequency driver 26 and equidistant from each other.

Thus, the wide angle dispersion with accurate phase response previously obtained by applicant with coaxial drivers and delay can be obtained with the symmetric geometries and delay illustrated and disclosed above. However, power capacity of the loudspeaker is enhanced, particularly at the lower frequencies.

By applying the symmetric arrangement of FIG. 3 to mirror image stereo pairs of loudspeakers, the high frequency drivers 42 can be moved outboard as illustrated in FIG. 5. By offsetting the high frequency driver 42 outboard a distance indicated by 46 to vertical line 44 from the vertical line 48 through the centers of the upper and lower low frequency drivers 50 and 52 respectively, geometric delay in the horizontal direction is accomplished. In the preferred embodiment the outboard offset provides a portion of the delay, the remainder being provided by the electric delay circuit to the high frequency driver 42. The result is an enhanced phase angle response skewed in the preferred direction between and in front of the stereo pair where a listener is expected. However, the included angle of accurate phase response for each loudspeaker is widened by use of the electric delay circuitry disclosed in applicant's above referenced patents and patent applications.

Figure 6:
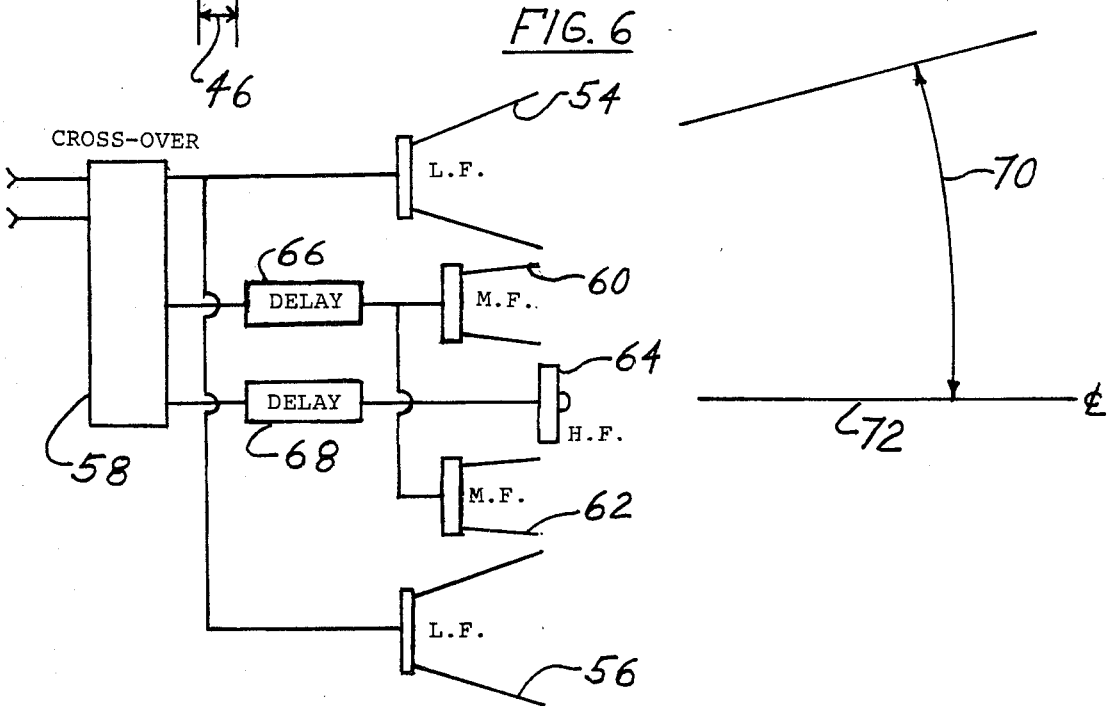
FIG. 6 is a schematic sketch of a pair of low frequency drivers symmetric about a pair of mid-frequency drivers and a high frequency driver.
Figure 7:
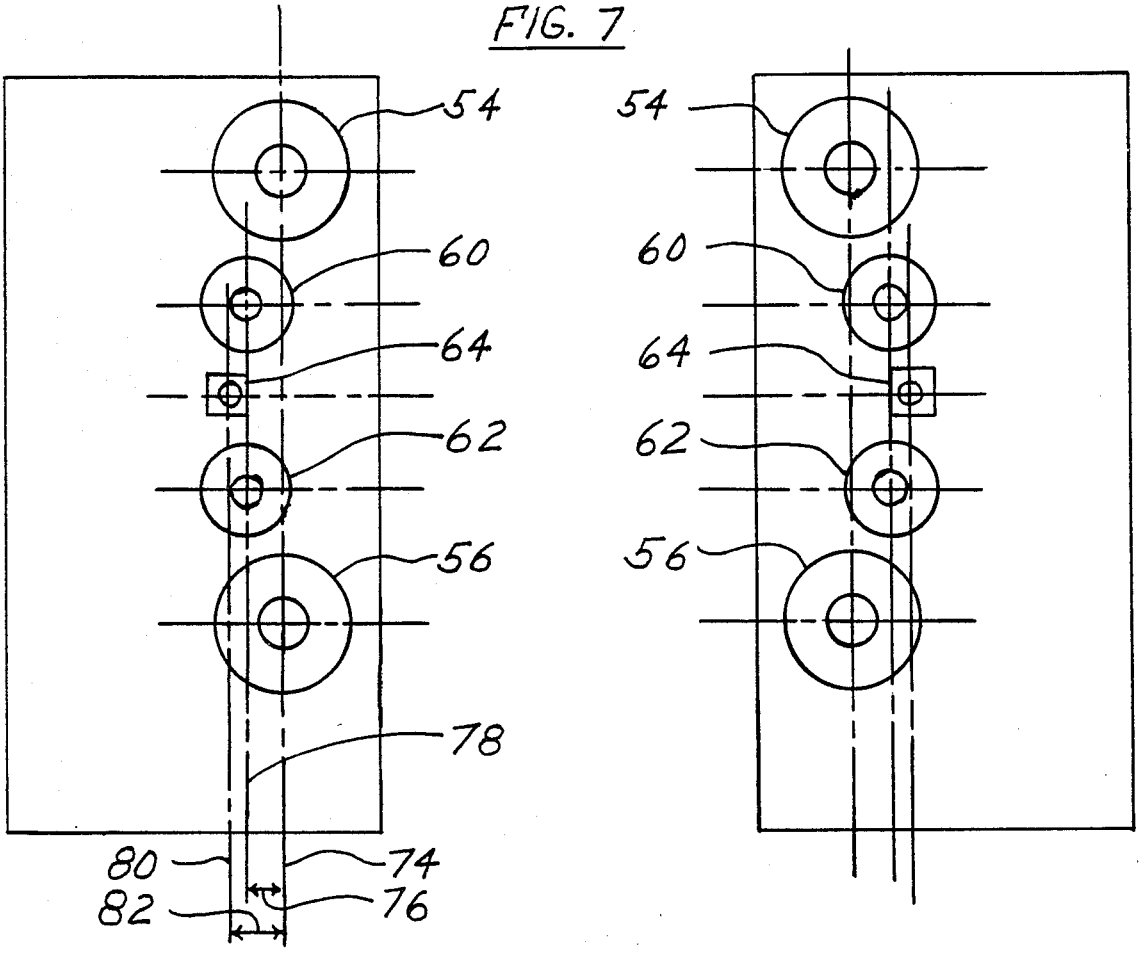
FIG. 7 is a schematic front view of the drivers of FIG. 6 shown in a pair of mirror image loudspeakers, the high frequency and mid-frequency drivers being offset from the low frequency drivers.

Illustrated in FIGS. 6 and 7 is a stereo pair of loudspeakers and the circuitry for either loudspeaker incorporating pairs of mid-frequency or range drivers. In FIG. 6 upper and lower low frequency drivers 54 and 56 respectively are connected through a crossover circuit 58 as are the upper and lower mid-range drivers 60 and 62 respectively and the high frequency driver 64. The mid-range drivers 60 and 62 may include a mid-range delay circuit 66 and the high frequency driver 64 includes a high frequency electric delay circuit 68. As above, however, mid-range and high frequency delay may also be partially geometric as a result of the physical configuration of the drivers. The proper adjustment of the electric and geometric delays provide enhanced phase response accuracy over a wide solid angle as indicated by angle 70 relative to the axis 72 of the high frequency driver 64.

In FIG. 7 geometric delay adjustment for the desired listening angle is provided by positioning the drivers in mirror image arcs. The mid-range drivers 60 and 62 are offset along a vertical line 74 as indicated by 76 from a vertical line 78 through the centers of the low frequency drivers 54 and 56. The high frequency driver 64 is outboard offset on a vertical line 80, a greater amount 82 from the vertical line 74. As above, however, the pair of mid-range drivers 60 and 62 are equidistant from the high frequency driver 64 and the low frequency drivers 54 and 56 are also equidistant from the high frequency driver 64. As a stereo pair of loudspeakers an enhanced phase response accuracy is provided to a listener positioned between and in front of the loudspeaker pair and the basic wide solid angle phase coherent response is retained in front of each loudspeaker by the symmetry, in combination with delay equalization built into the circuits driving the mid-range and high frequency drivers and the inherent front to back positioning the mid-range and high frequency drivers relative to the low frequency drivers.

Figure 8:
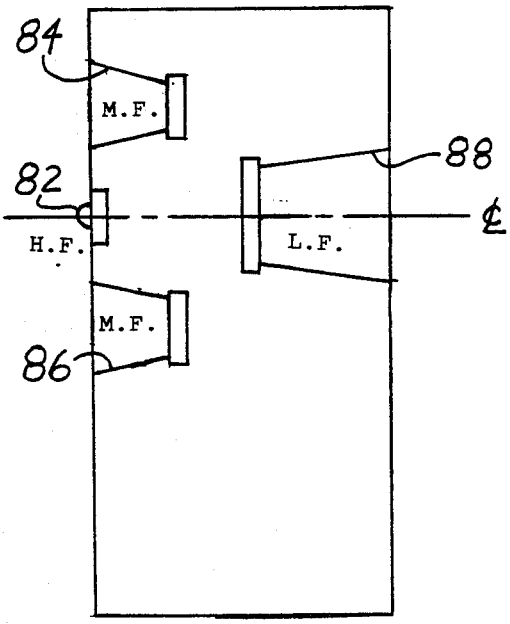
FIG. 8 is a schematic side view of a loudspeaker having symmetric high, mid-range and low frequency drivers, the latter back facing.
Figure 9:
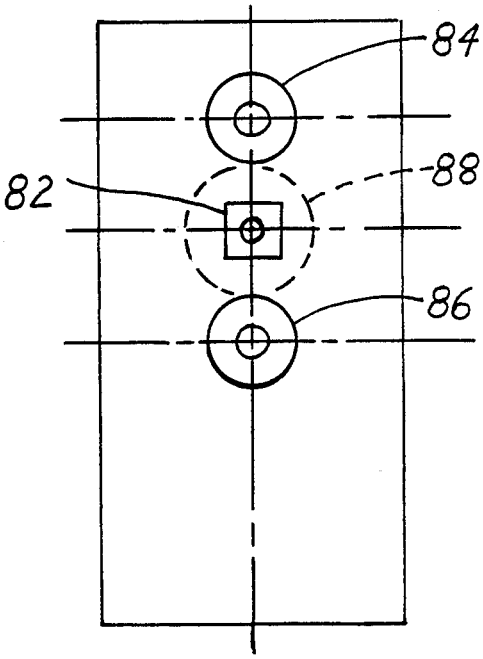
FIG. 9 is a schematic front view of the loudspeaker of FIG. 8.

Illustrated in FIGS. 8 and 9 is a loudspeaker incorporating a high frequency driver 82 and a pair of mid-range drivers 84 and 86 both equidistant from the high frequency driver and all front facing. A low frequency driver 88 is positioned back facing and on the same axis as the high frequency driver 82. The inherent symmetry of the combination of drivers combined with a properly adjusted delay network to the high frequency driver results in enhanced phase coherence and accuracy about the loudspeaker clearly illustrating the surprising result that symmetry in placement of the drivers is substantially more important than the distance between drivers. From an acoustic standpoint the low frequency driver 88 may be either back facing as shown or front facing coaxial with the high frequency driver 82. The result is spatial phase coherence about the loudspeaker if combined with applicant's electric delay equalization.

Loudspeakers constructed according to the above disclosures, incorporating crossover circuitry from applicant's above referenced patents and patent applications and adjusted with the methods disclosed by applicant therein, exhibit spatial phase coherence equivalent to coaxial drivers but with superior power capability at the lower frequencies.

I claim:

1. A loudspeaker comprising a high frequency driver and a plurality of relatively lower frequency drivers, said lower frequency drivers positioned symmetrically in pairs in at least one dimension about the high frequency driver, and a combination of electric means and geometric means to together cause delay of the acoustic waves emanating from the high frequency driver relative to the lower frequency drivers, wherein the lower frequency drivers comprise a plurality of driver pairs positioned above and below and to either side of the high frequency driver in a symmetric arrangement about the high frequency driver.

2. A loudspeaker for phase coherent acoustic reproduction comprising a high frequency driver and a plurality of relatively lower frequency drivers, said lower frequency drivers paired symmetrically in at least one dimension about the high frequency driver, and a combination of electric means and geometric means to together cause delay of the acoustic waves emanating from the high frequency driver relative to the lower frequency drivers, wherein the lower frequency drivers comprise a single pair placed above and below the high frequency driver, the axis of the high frequency driver being offset in a direction perpendicular to a line perpendicular to and joining the axes of the pair of lower frequency drivers, and said electric delay means connected to the high frequency driver, said electric delay means in combination with the geometric delay resulting from the offset producing phase coherent acoustic reproduction skewed in a direction opposite the high frequency driver offset direction.

3. A stereophonic mirror image pair of loudspeakers each constructed according to claim 2 wherein the high frequency drivers are offset horizontally outwardly away from each other.

4. A loudspeaker comprising a high frequency driver and a plurality of relatively lower frequency drivers, said lower frequency drivers positioned symmetrically in pairs in at least one dimension about the high frequency driver, and a combination of electric means and geometeric means to together cause delay of the acoustic waves emanating from the high frequency driver relative to the lower frequency drivers, and further including at least one separate low frequency driver, said separate low frequency driver positioned substantially symmetric to the high frequency driver.

5. The loudspeaker of claim 4 wherein the separate low frequency driver is facing backward relative to the other drivers.

6. The loudspeaker of claim 4 wherein the separate low frequency driver is front facing and coaxial with the high frequency driver.

7. A loudspeaker comprising a high frequency driver and a plurality of relatively lower frequency drivers, said lower frequency drivers positioned symmetrically in pairs in at least one dimension about the high frequency driver, and a combination of electric means and geometric means to together cause delay of the acoustic waves emanating from the high frequency driver relative to the lower frequency drivers, and further including at least one separate low frequency driver, said separate low frequency driver facing backward relative to the other drivers.

8. A loudspeaker comprising a high frequency driver, a plurality of low frequency drivers and a plurality of mid-frequency drivers, wherein at least a pair of low frequency drives are symmetrically positioned about the high frequency driver and wherein at least a pair of mid-frequency drivers are positioned symmetrically about the high frequency driver, geometric means to cause delay of the acoustic waves emanating from the mid-frequency drivers relative to the low frequency drivers and a combination of electric means and geometric means to together cause delay of the acoustic waves emanating from the high frequency driver relative to both the low frequency drivers and the mid-frequency drivers.

9. The loudspeaker of claim 8 wherein the axes of the pair of mid-frequency drivers are each offset in a direction perpendicular to a line perpendicular to and joining the axes of a pair of low frequency drivers, and the axis of the high frequency driver is further offset in a direction perpendicular to the line joining the axes of said pair of low frequency drivers a distance greater than the offset of the mid-frequency drivers.

10. A stereophonic mirror image pair of loudspeakers each constructed according to claim 9 wherein thr high frequency drivers and the sets of pairs of mid-frequency drivers are offset horizontally outwardly away from each other.

* * * * *